US012121789B2

(12) United States Patent
Woods

(10) Patent No.: US 12,121,789 B2
(45) Date of Patent: Oct. 22, 2024

(54) GOLF SWING TRAINING DEVICE AND METHOD OF USING THE SAME

(71) Applicant: David Woods, Indian Wells, CA (US)

(72) Inventor: David Woods, Indian Wells, CA (US)

( * ) Notice: Subject to any disclaimer, the term of this patent is extended or adjusted under 35 U.S.C. 154(b) by 0 days.

(21) Appl. No.: 17/647,714

(22) Filed: Jan. 11, 2022

(65) Prior Publication Data

US 2023/0218965 A1 Jul. 13, 2023

(51) Int. Cl.
*A63B 69/36* (2006.01)
*A63B 69/00* (2006.01)

(52) U.S. Cl.
CPC ..... *A63B 69/0059* (2013.01)

(58) Field of Classification Search
CPC ..... A63B 69/0059; A63B 2225/09; A63B 69/3623
USPC ..... 473/205, 213, 214, 276, 458
See application file for complete search history.

(56) References Cited

U.S. PATENT DOCUMENTS 3,400,934 A 9/1968 Muehl
3,423,095 A * 1/1969 Cox ..... A63B 69/0059 446/901
3,606,342 A * 9/1971 Albertson, Jr. ..... A63B 71/146 473/213
3,700,245 A * 10/1972 Nannini ..... A63B 69/0059 473/213
4,241,922 A * 12/1980 Elliott, Jr. ..... A63B 69/0059 473/213
5,447,312 A 9/1995 Nixon et al.
5,499,820 A * 3/1996 Albertsson ..... A63B 69/0059 273/DIG. 30
5,634,854 A * 6/1997 Albertsson ..... A63B 69/0059 273/DIG. 30
5,876,292 A * 3/1999 Hamilton ..... A63B 69/3608 273/DIG. 30
2006/0172812 A1* 8/2006 Kraus ..... A63B 69/0059 473/212

FOREIGN PATENT DOCUMENTS

GB 2166959 A * 5/1986 ..... A63B 69/0059

OTHER PUBLICATIONS

International Search Report and Written Opinion for PCT/US2023/065438, dated May 19, 2023 (14 pages).

* cited by examiner

*Primary Examiner* — Nini F Legesse
(74) *Attorney, Agent, or Firm* — FisherBroyles, LLP; Rob L. Phillips

(57) ABSTRACT

A golf swing training device attachable to a golfer's wrist. A rigid hand stop prevents the golfer's hand from bending beyond a pre-established distance or angle during a golf backswing. The rigid hand stop is configured and positioned to not interfere with, or restrict, the golfer's address of the golf ball or the early part of the backswing. The rigid hand stop allows desired movement of, and prevents undesired movement of, the golfer's rear hand (i.e., right hand for right-handed golfers and left hand for left-handed golfers) as the golfer moves from ball address through the backswing to the downswing to the impact position and finally the follow through.

9 Claims, 9 Drawing Sheets

GOLF SWING TRAINING DEVICE AND METHOD OF USING THE SAME

FIELD OF THE INVENTION

The embodiments of the present invention relate to a device for teaching hand position through a golf swing.

BACKGROUND

Golf is an extremely popular sport played by millions of people around the world. Despite its popularity, golf is an extremely frustrating game. The most difficult aspect of golf is mastering the swing. However, mastering the golf swing is easier said than done. A good golf swing requires many facets, including proper hand position.

It would be advantageous to develop a simple, inexpensive device and method of using the same for teaching golfer's the proper hand position throughout a golf swing.

SUMMARY

One well-known problem encountered by golfer's is breaking of their hands or wrists during the backswing. When this occurs, the entire golf swing may be thrown off resulting in poor quality golf shots.

One embodiment of the present invention is directed to a device comprising: a wrist portion for attaching the device to the golfer's wrist and providing stability and a hand portion for preventing an overly bent hand. The hand portion of the device is configured to allow desired movement of, and prevent undesired movement of, the golfer's rear hand (i.e., right hand for right-handed golfers and left hand for left-handed golfers) as the golfer moves from ball address through the backswing to the downswing to the impact position and finally the follow through.

As designed, the rigid hand portion of the device assists golfers with maintaining proper hand position throughout a golf swing. The rigid hand portion is designed such that the rear hand may flex rearward when desired (e.g., at address and elsewhere during the golf swing) but prevent overly flexing during various golf swing points.

Other variations, embodiments and features of the present invention will become evident from the following detailed description, drawings and claims.

DETAILED DESCRIPTION

Figure 1:
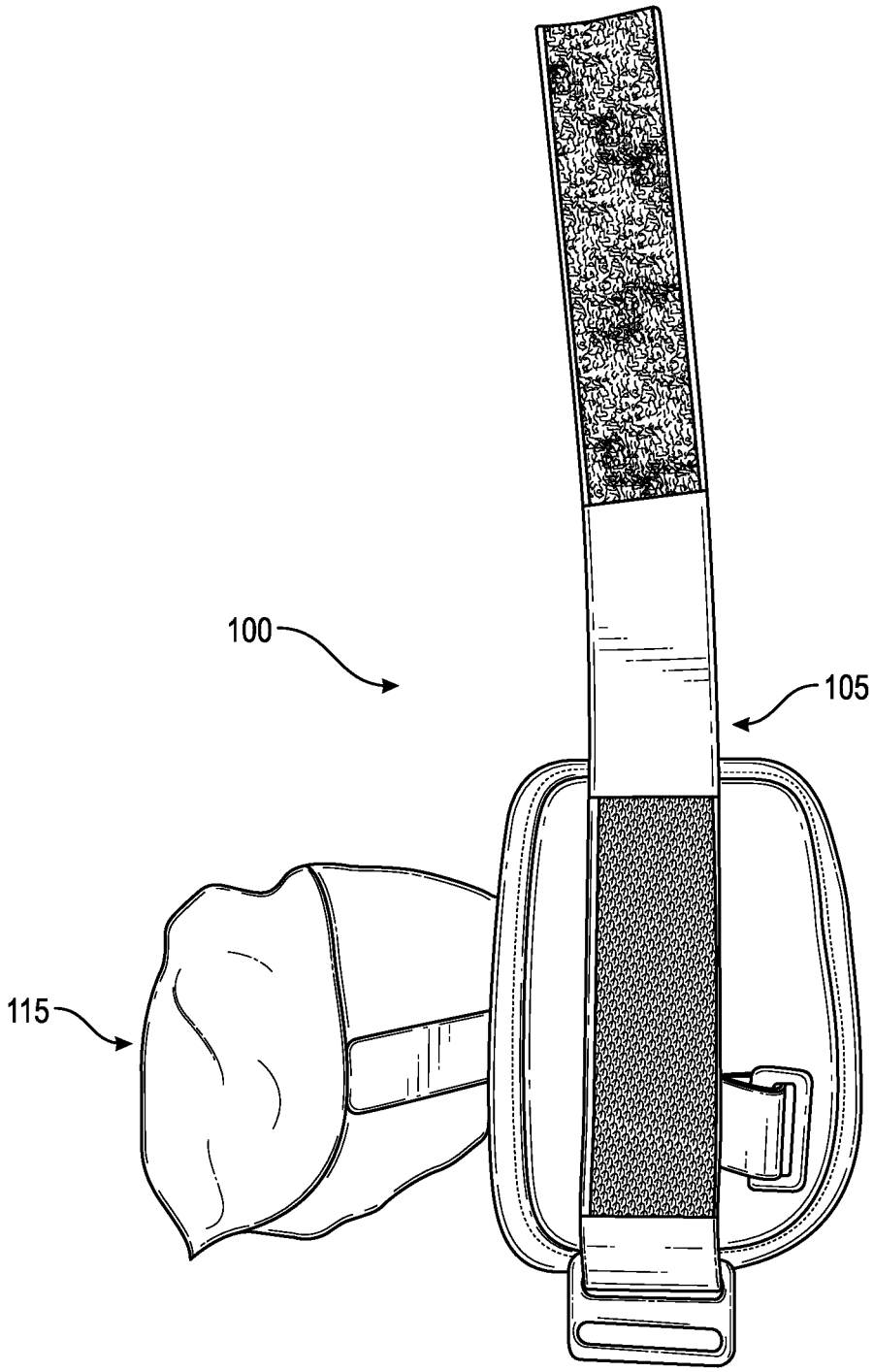
FIG. 1 illustrates a top-down rear view of a golf swing training device in an open position according to the embodiments of the present invention.
Figure 2:
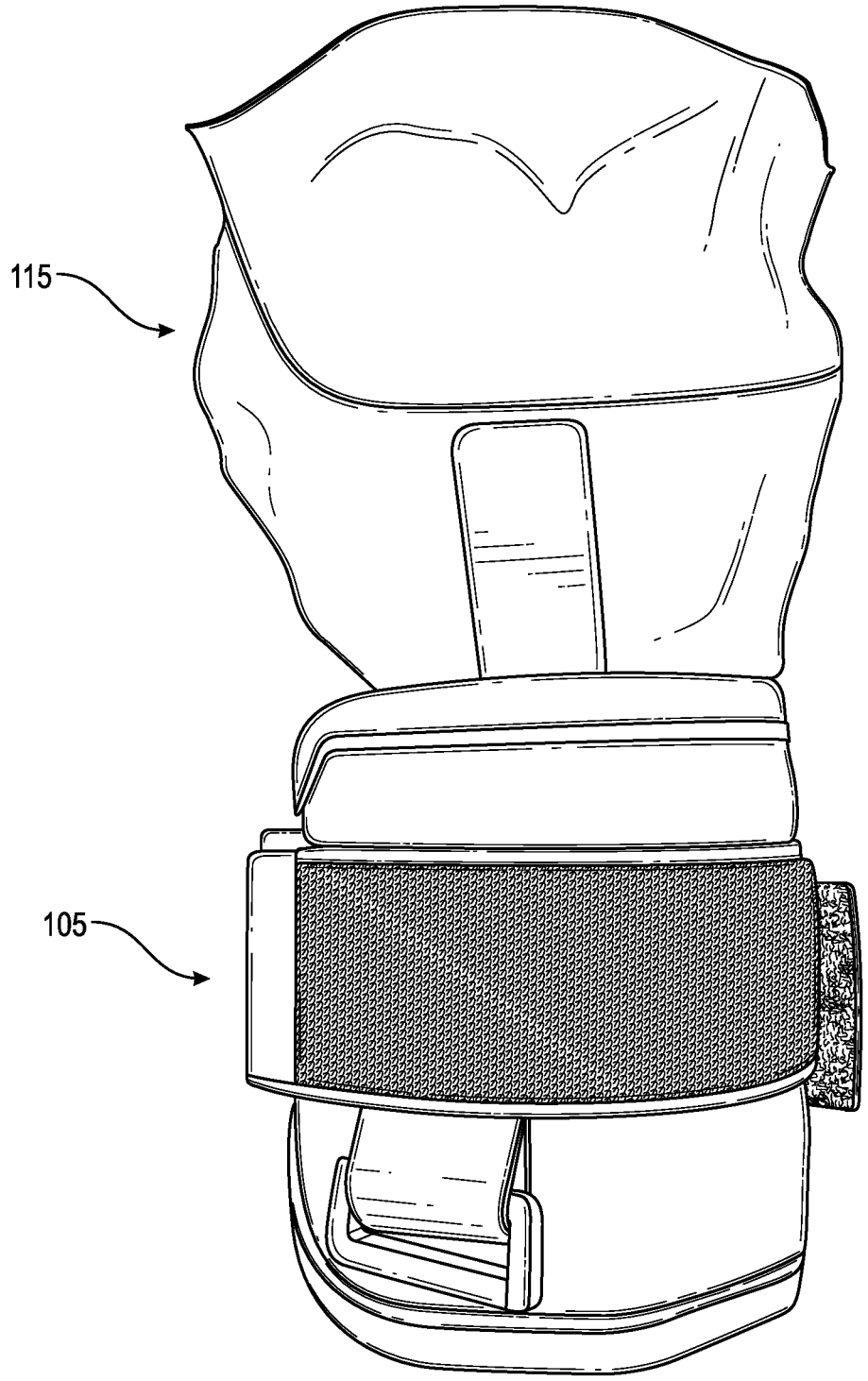
FIG. 2 illustrates a top-down rear view of the golf swing training device in a closed position according to the embodiments of the present invention.
Figure 3:
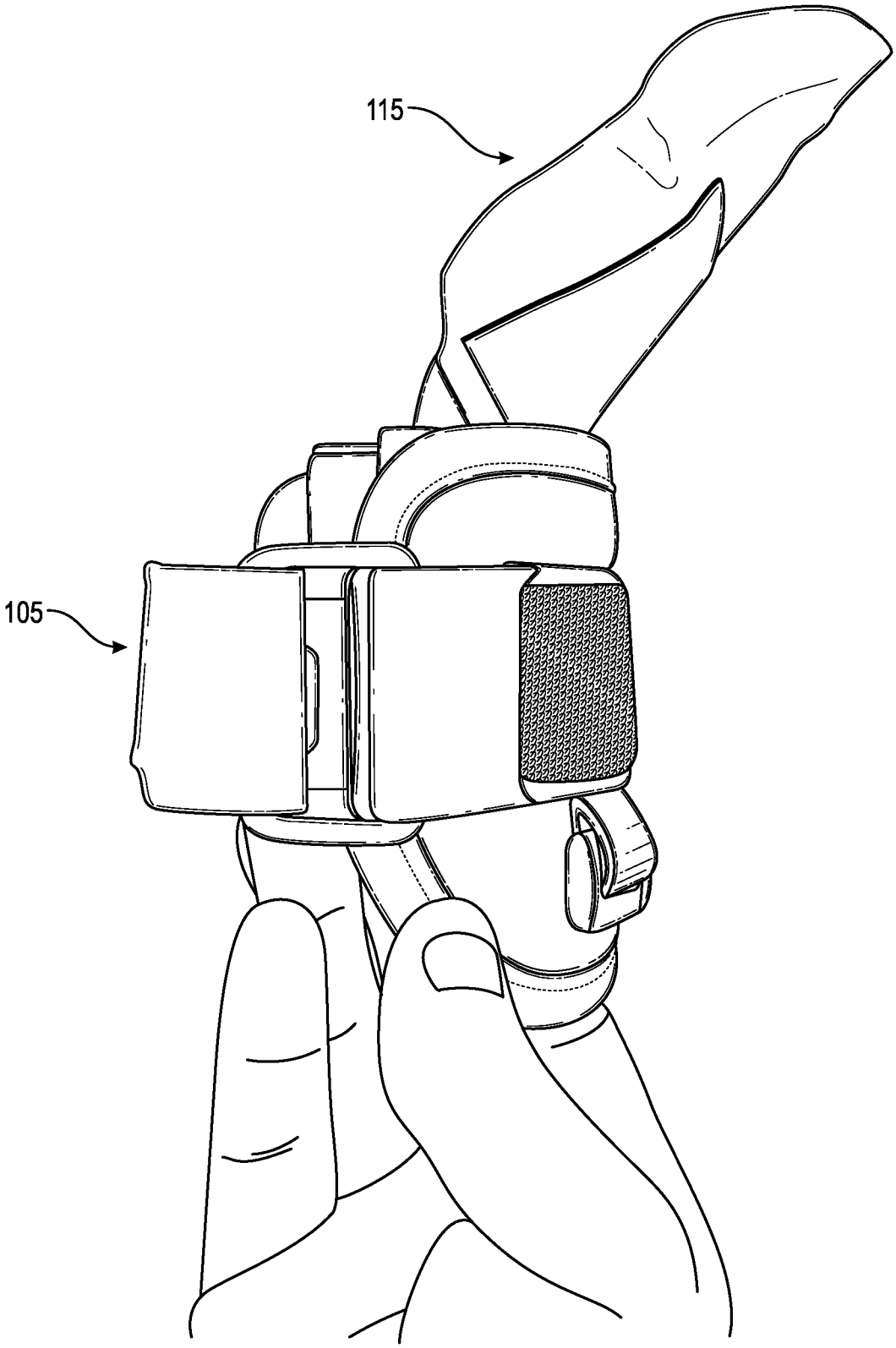
FIG. 3 illustrates a side view of the golf swing training device in a closed position according to the embodiments of the present invention.
Figure 4:
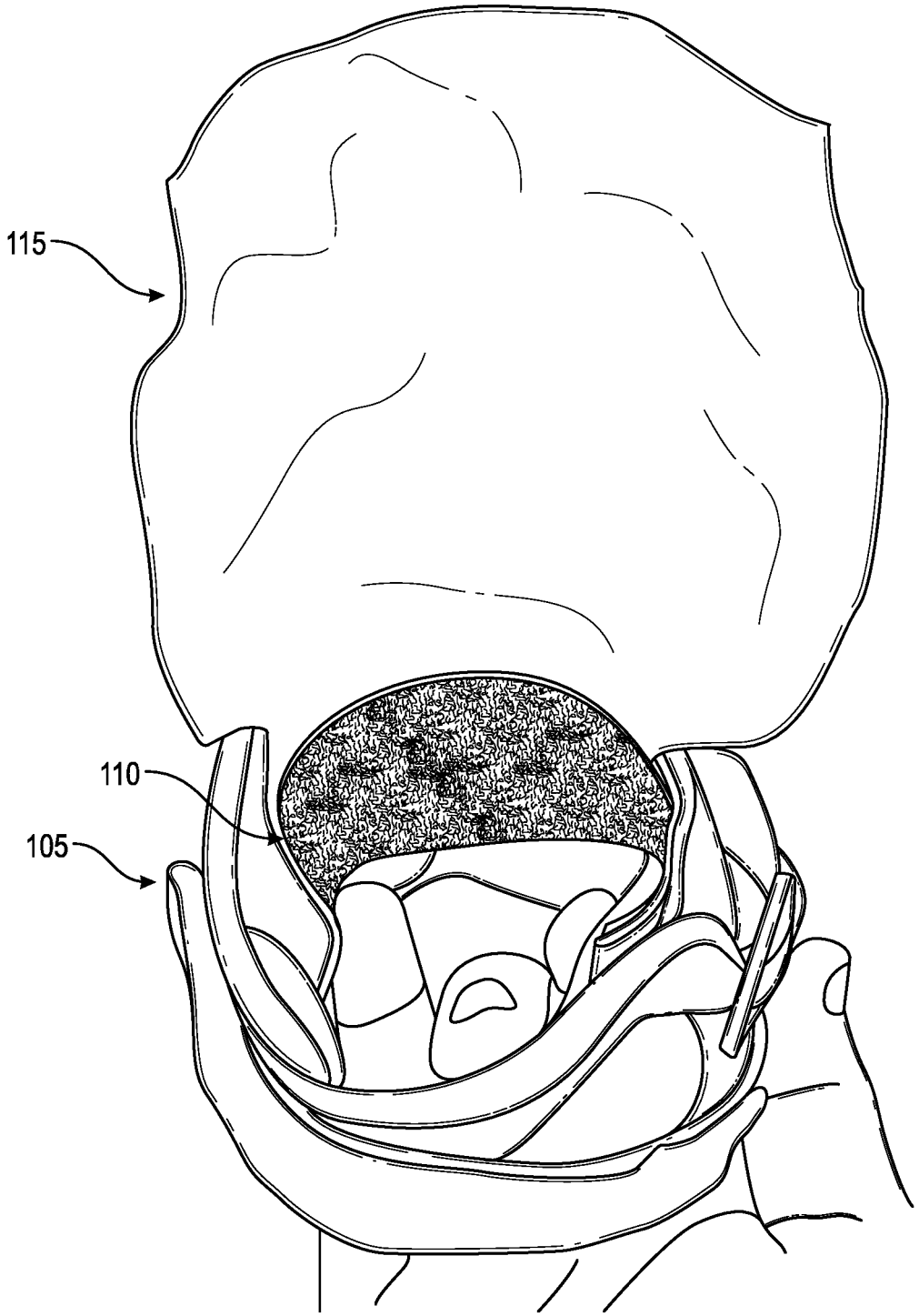
FIG. 4 illustrates a front view of the golf swing training device in a closed position according to the embodiments of the present invention.
Figure 5:
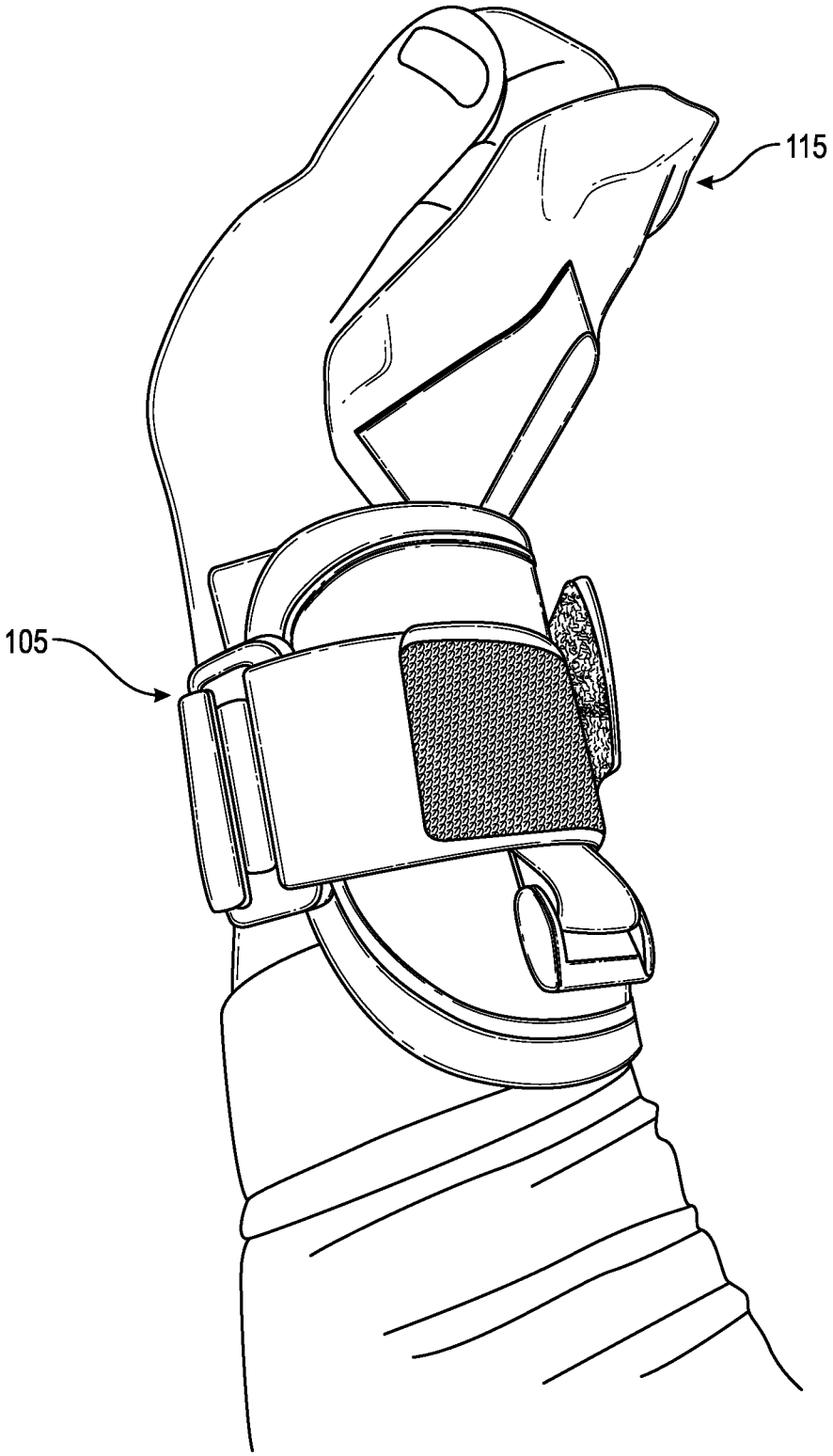
FIG. 5 illustrates the golf swing training device being worn and a golfer's wrist able to flex rearward according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Those skilled in the art will recognize that the components of the golf swing training device according to the embodiments of the present invention may be fabricated of any suitable materials. For example, the hand and wrist portion may be fabricated of plastics, alloys, metals, composites, rubber, etc.

In broadest form, the embodiments of the present invention comprise a device having a wrist portion for attaching the device to the golfer's wrist and providing stability and a hand portion for preventing an overly flexed hand/wrist during the backswing.

FIGS. 1-5 show various views of the golf swing training device 100 according to the embodiments of the present invention. As shown, the device 100 includes an adjustable strap 105, wrist support 110 and rigid hand stop 115. In one embodiment, the wrist support 110 is a rigid semi-circular member configured to retain a golfer's wrist. As shown, the wrist support 110 is integral with the rigid hand stop 115. Alternatively, the wrist support 110 may be integral with the adjustable strap 105.

The adjustable strap 105 is configured to affix the golf swing training device 100 to the wrist of the golfer's rear hand around the wrist support 110. In one embodiment, the strap incorporates a longitudinal portion to provide additional support to the wrist. In one embodiment, when affixed to the wrist, the adjustable strap 105 tightens about the wrist support 110 thereby keeping the wrist secured as well as the golf swing training device 100 secure thereon.

Figure 6A:
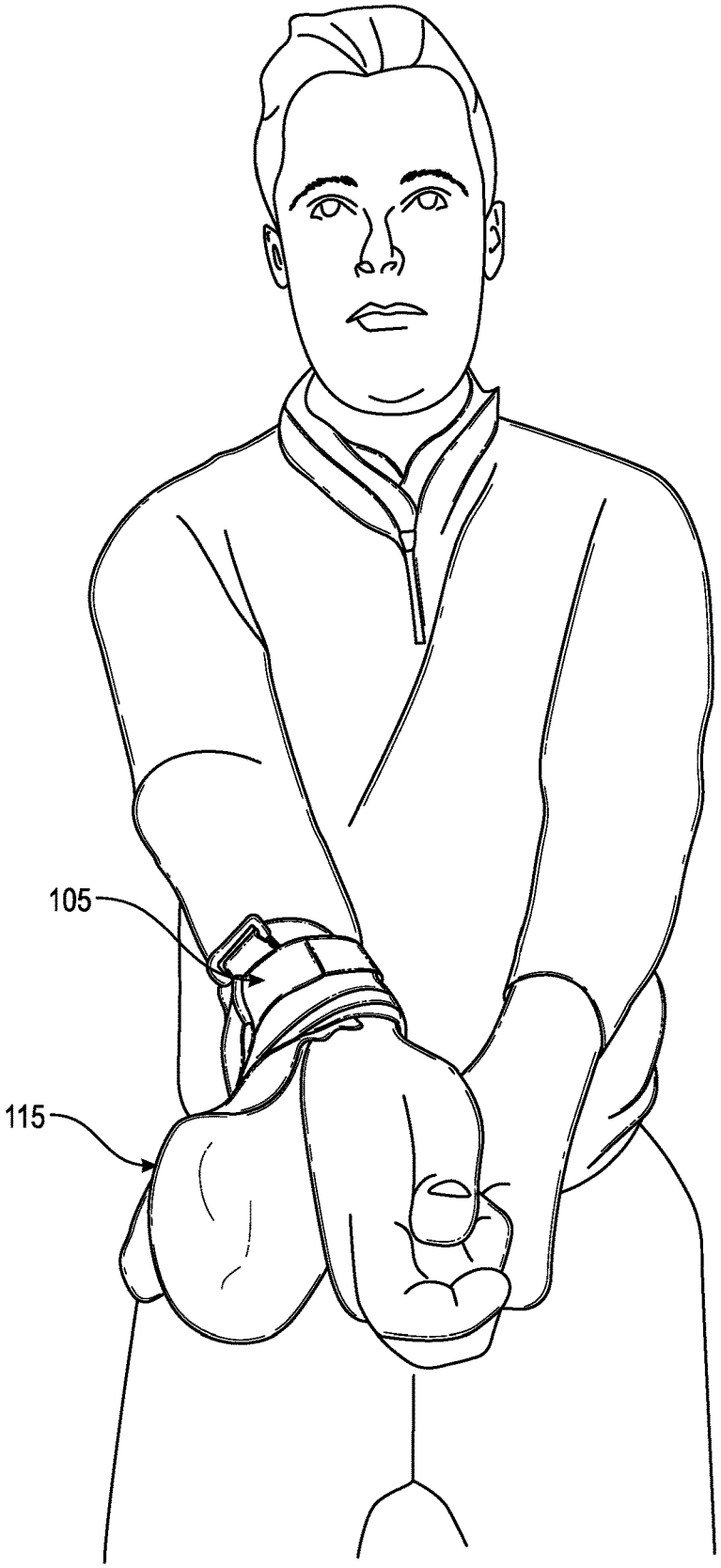
FIGS. 6A-6C illustrate the golf swing training device being worn as a golfer progresses through a backswing according to the embodiments of the present invention.

The rigid hand stop 115 extends from the wrist support 110 forward towards the back of the rear hand of the golfer when worn. As best shown in FIG. 6A, the rigid hand stop 115 extends, at an angle A relative to the forearm of the golfer forming a space between the back of the hand and the rigid hand stop 115. In other words, the rigid hand stop 115 extends away from the golfer's hand when it is an extension of the plane of the forearm. In one embodiment, the rigid hand stop is positioned commensurate with a professional golfer's hand position.

Figure 6B:
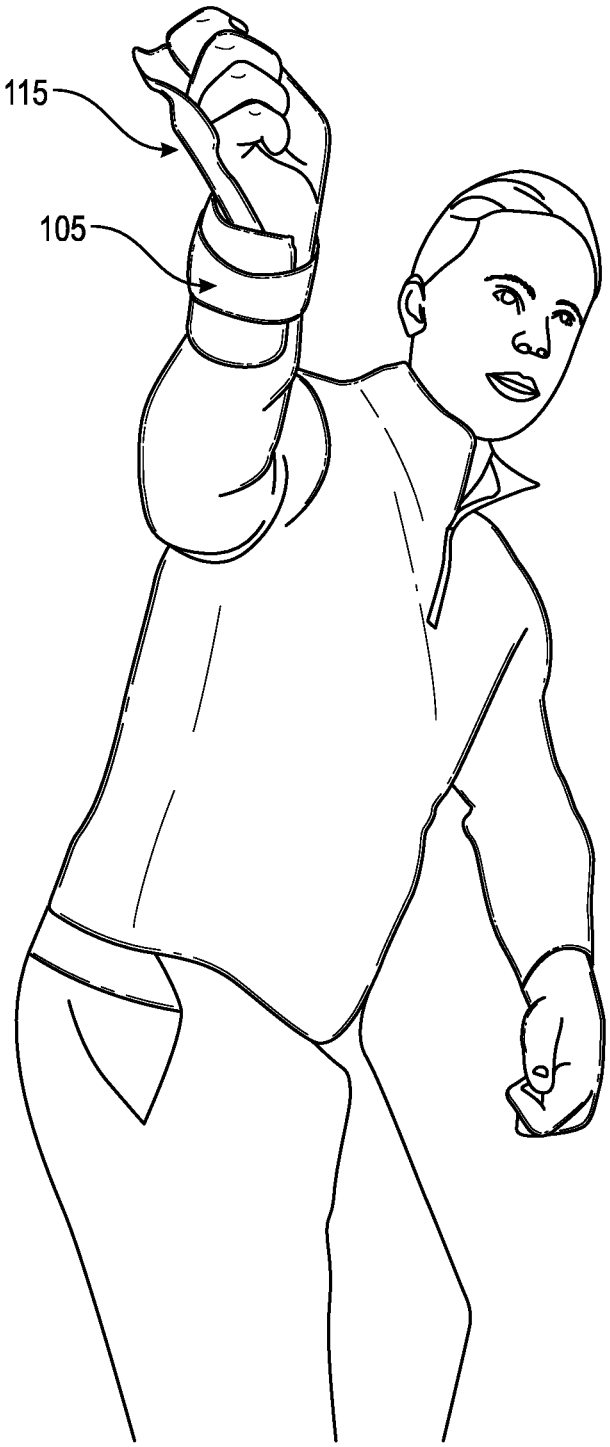
Figure 6C:
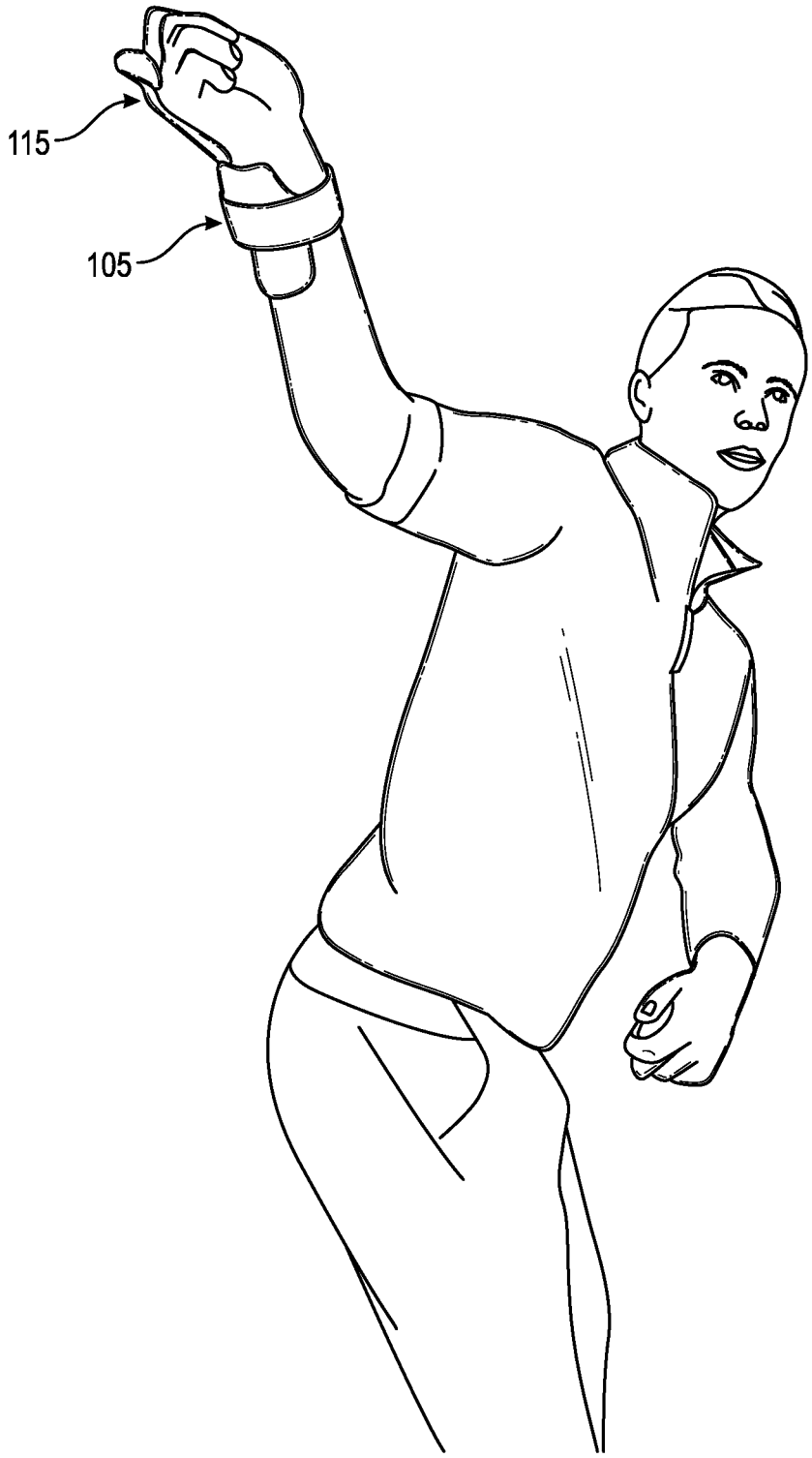

As shown in FIG. 6A, when the golfer addresses the ball, the space is empty. In this manner, the golfer can address the ball in a normal fashion. As shown in FIGS. 6B and 6C, as the golfer moves through the backswing, the space permits the rear hand to bend about the wrist towards the rigid hand stop 115. The rigid hand stop 115 is configured to prevent the rear hand from bending too far and negatively affecting the golfer's swing.

Figure 7:
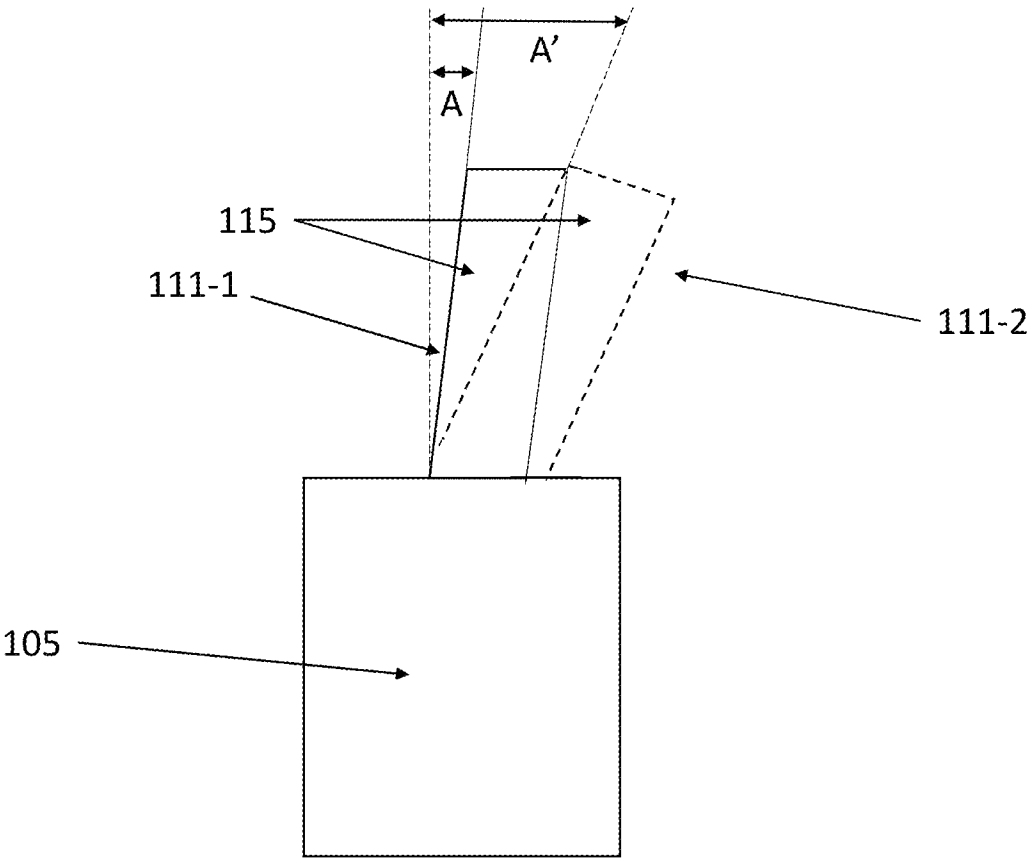
FIG. 7 illustrates the golf swing training device with an adjustable rigid hand stop according to the embodiments of the present invention.

In one embodiment, the rigid hand stop 115 is designed to accommodate the golfer's hand by taking on a concave shape. In another embodiment, the rigid hand stop 115 may incorporate finger channels or grooves to accommodate and receive at least upper portions of each finger of the golfer. In another embodiment, as shown in FIG. 7, the rigid hand stop 115 may be positionally adjusted to change angle A to accommodate different golf swings of different golfers. As shown, the rigid hand stop 115 can be moved from a first position 111-1 to a second position thereby changing angle A to larger angle A' (or a smaller angle A (not shown)). A spring-biased hinge and lock combination or other mechanism may facilitate the adjustment of the rigid hand stop 115.

Although the invention has been described in detail with reference to several embodiments, additional variations and modifications exist within the scope and spirit of the invention as described and defined in the following claims.

I claim:

1. A golf swing training device comprising:

a strap configured for attachment to a wrist of a user;

a rigid wrist support in communication with said strap, said rigid wrist support in a form of a semi-circular member dimensioned to wrap partially around, and contact upper and side portions of, a wrist area of a user;

a rigid hand stop fixedly angled to define a space between the rigid hand stop and a rear surface of a hand of a user when worn thereby preventing a hand from rotating beyond a pre-established angle about the wrist during a golf swing; and wherein said rigid wrist support is integral with said rigid hand stop such that said rigid hand stop extends directly from a leading edge of said rigid wrist support.

2. The golf swing training device of claim 1 wherein said space accommodates the hand of the user when the hand is bent rearward.

3. The golf swing training device of claim 1 wherein said rigid hand stop prevents the hand of the user to bend beyond a pre-established distance.

4. The golf swing training device of claim 1 wherein said rigid hand stop prevents the hand of the user to bend beyond a pre-established angle relative to a plane of the forearm of the user.

5. The golf swing training device of claim 1 wherein said rigid hand stop is concave in shape.

6. A golf swing training device comprising:

a strap configured for attachment to a wrist of a user;

a rigid wrist support in communication with said strap, said rigid wrist support in a form of a semi-circular member dimensioned to wrap partially around, and contact upper and side portions of, a wrist area of a user;

a rigid hand stop (i) angled to define a space between the rigid hand stop and a rear surface of a hand of a user when worn thereby preventing a hand from rotating beyond a pre-established angle about the wrist during a golf swing and (ii) adjustable to change the angle defining the space; and wherein said wrist support is integral with said rigid hand stop such that said rigid hand stop extends directly from a leading edge of said rigid wrist support.

7. The golf swing training device of claim 6 wherein said rigid hand stop prevents the hand of the user to bend beyond a pre-established distance.

8. The golf swing training device of claim 6 wherein said rigid hand stop prevents the hand of the user to bend beyond a pre-established angle relative to a plane of the forearm of the user.

9. The golf swing training device of claim 6 wherein said rigid hand stop is concave in shape.

* * * * *